US008958729B2

(12) United States Patent
Innami et al.

(10) Patent No.: US 8,958,729 B2
(45) Date of Patent: Feb. 17, 2015

(54) MAGNET ROLLER, DEVELOPER BEARER, DEVELOPMENT DEVICE, PROCESS CARTRIDGE, AND IMAGE FORMING APPARATUS

(71) Applicants: Takashi Innami, Kanagawa (JP); Noriyuki Kamiya, Kanagawa (JP); Masayuki Ohsawa, Kanagawa (JP); Yoshiyuki Takano, Tokyo (JP); Hiroya Abe, Kanagawa (JP)

(72) Inventors: Takashi Innami, Kanagawa (JP); Noriyuki Kamiya, Kanagawa (JP); Masayuki Ohsawa, Kanagawa (JP); Yoshiyuki Takano, Tokyo (JP); Hiroya Abe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 86 days.

(21) Appl. No.: 13/761,735

(22) Filed: Feb. 7, 2013

(65) Prior Publication Data

US 2013/0236216 A1 Sep. 12, 2013

(30) Foreign Application Priority Data

Mar. 8, 2012 (JP) ..... 2012-051312

(51) Int. Cl.
*G03G 15/09* (2006.01)
*H01F 7/00* (2006.01)

(52) U.S. Cl.
CPC ..... *G03G 15/0921* (2013.01); *H01F 7/00* (2013.01)
USPC ..... 399/277; 399/267

(58) Field of Classification Search
CPC ..... G03G 15/0921; G03G 15/0928; G03G 15/0935
USPC ..... 399/267, 277
See application file for complete search history.

(56) References Cited

U.S. PATENT DOCUMENTS

| | | | | |
|---|---|---|---|---|
| 6,311,026 | B1 * | 10/2001 | Higeta et al. | 399/13 |
| 6,324,372 | B1 * | 11/2001 | Hirota | 399/277 |
| 8,472,816 | B2 * | 6/2013 | Muto | 399/13 |
| 2002/0114647 | A1 | 8/2002 | Imamura et al. | |
| 2008/0298849 | A1 | 12/2008 | Imamura et al. | |
| 2009/0232563 | A1 | 9/2009 | Innami et al. | |

FOREIGN PATENT DOCUMENTS

| | | |
|---|---|---|
| JP | 61-079212 | 4/1986 |
| JP | 1-140615 | 6/1989 |
| JP | 2001-165148 | 6/2001 |
| JP | 2001-175073 | 6/2001 |
| JP | 2002-514002 | 5/2002 |
| JP | 2006-308663 | 11/2006 |
| JP | 2007-219254 | 8/2007 |
| JP | 2009-169258 | 7/2009 |
| JP | 2010-032790 | 2/2010 |
| WO | WO 99/56933 A1 | 11/1999 |

* cited by examiner

*Primary Examiner* — Gregory H Curran
(74) *Attorney, Agent, or Firm* — Oblon, Spivak, McClelland, Maier & Neustadt, L.L.P.

(57) ABSTRACT

A magnet roller includes a roller-shaped body constructed of a magnetic field generating material, a first support rod provided to a first axial end of the body; and a second support rod provided to a second axial end of the body. At least one of the first and second support rods is constructed of a nonmagnetic material and includes a projecting part projecting outside the body from an end face of the body and a buried part united to the projecting part and positioned inside the body. The buried part includes a reduced-area portion smaller than a base end of the projecting part adjacent to the buried part in cross-sectional area perpendicular to an axial direction of the first and second support rods.

10 Claims, 8 Drawing Sheets

MAGNET ROLLER, DEVELOPER BEARER, DEVELOPMENT DEVICE, PROCESS CARTRIDGE, AND IMAGE FORMING APPARATUS

CROSS-REFERENCE TO RELATED APPLICATION

This patent application is based on and claims priority pursuant to 35 U.S.C. §119 to Japanese Patent Application No. 2012-051312, filed on Mar. 8, 2012, in the Japan Patent Office, the entire disclosure of which is hereby incorporated by reference herein.

BACKGROUND OF THE INVENTION

1. Field of the Invention

The present invention generally relates to a magnet roller for use in an image forming apparatus, such as a copier, a printer, a facsimile machine, or a multifunction machine having at least two of these capabilities; and a developer bearer, a development device, a process cartridge, and an image forming apparatus including same.

2. Description of the Related Art

Electrophotographic image forming apparatuses typically include a latent image bearer, such as a drum-shaped or belt-shaped photoreceptor, on which electrostatic latent images are formed according to image data, and a development device to develop the electrostatic latent images. In electrophotographic image forming apparatuses, magnetic brush development methods using two-component developer consisting essentially of toner and magnetic carrier are widely used.

In magnetic brush development methods, developer is magnetically adsorbed onto an outer circumferential surface of the developer bearer, thus forming a magnetic brush. Then, in a development range formed between the developer bearer and the latent image bearer, toner is supplied from the magnetic brush to the electrostatic latent image formed on the latent image bearer, thereby developing it.

Developer bearers for use in such magnetic brush development methods typically include a cylindrical development sleeve constructed of a nonmagnetic material, and a magnet roller is provided disposed inside the development sleeve for generating magnetic force on the surface of the development sleeve. Magnetic carrier particles contained in developer are caused to stand on end on the development sleeve along the lines of the magnetic force thereon. Then, toner particles adhere to the magnetic carrier particles standing on end, forming a magnetic brush.

For example, JP-2001-165148-A proposes magnet rollers that include a cylindrical body and a pair of support portions provided on both sides of the body as shown in FIGS. 21 and 22.

A magnet roller 701 shown in FIG. 21 is shaft insertion type and includes a body 702 constructed of resin magnet and a metal shaft 705 penetrating the body 702 coaxially. Both ends of the metal shaft 705 serve as support portions 703 and 704.

The magnet roller 701 shown in FIG. 21 can have a high degree of rigidity and excel in durability owing to the metal shaft 705. However, if the magnet roller is reduced in diameter to respond to demands for compact image forming apparatuses, the volume of the resin magnet is reduced, resulting in insufficient magnetic force. Thus, it is difficult to reduce the size of shaft insertion type magnet rollers.

A magnet roller 801 shown in FIG. 22 is constructed of resin magnet, and a body 802 and a pair of support portions 803 and 804 are continuously formed by monolithic molding. Thus, the magnet roller 801 is monolithic molding type. Since the entire magnet roller 801 shown in FIG. 22 is constructed of resin magnet, this configuration can attain a stronger magnetic force than that attained by shaft insertion type magnet rollers.

SUMMARY OF THE INVENTION

In view of the foregoing, one embodiment of the present invention provides a magnet roller that includes a roller-shaped body constructed of a magnetic field generating material, a first support rod provided to a first axial end of the body, and a second support rod provided to a second axial end of the body. At least one of the first and second support rods is constructed of a nonmagnetic material and includes a projecting part projecting outside the body from an end face of the body and a buried part united to the projecting part and positioned inside the body from the end face of the body. The buried part includes a reduced-area portion smaller in cross-sectional area perpendicular to an axial direction of the first and second support rods than a base end of the projecting part adjacent to the buried part.

In another embodiment, a developer bearer includes the above-described magnet roller and a hollow cylindrical rotator provided outside the magnet roller to rotate around an axis relative to the magnet roller.

In yet another embodiment, a development device includes the above-described magnet roller and a support rod mount to which the first and second support rods are fixed.

In yet another embodiment, an image forming apparatus includes a latent image bearer and the above-described development device to develop a latent image formed on the latent image bearer with developer.

In yet another embodiment, the latent image bearer and the development device are housed in a unit casing of a process cartridge that is removably installed in the image forming apparatus.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 7 schematically illustrates a configuration around a cavity of the mold shown in

FIG. 6;

DETAILED DESCRIPTION OF THE INVENTION

Figure 1:
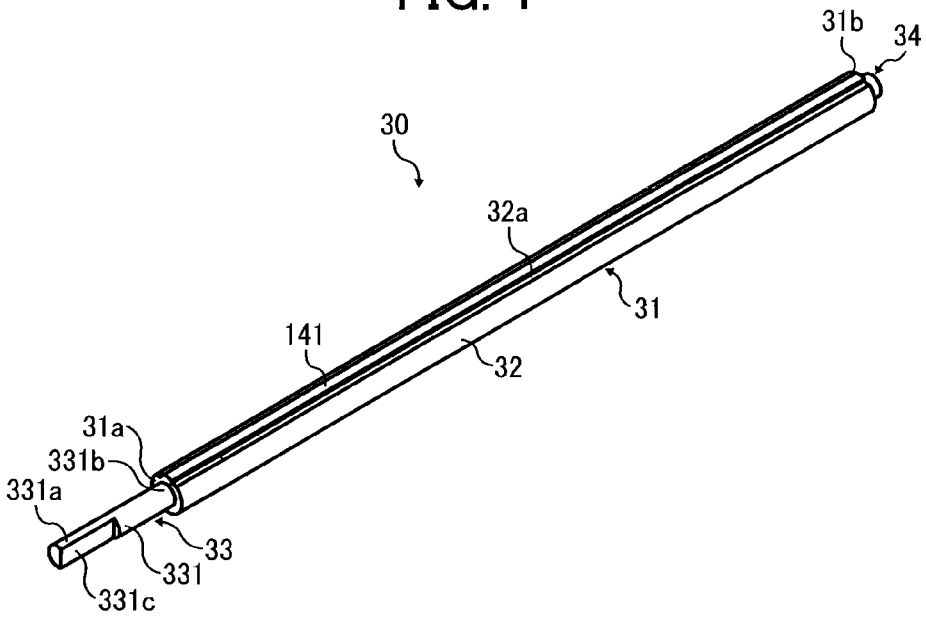
FIG. 1 is a perspective view of a magnet roller according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIGS. 1 through 12, a magnet roller for used in an image forming apparatus according to an embodiment of the present invention is described.

Figure 2:
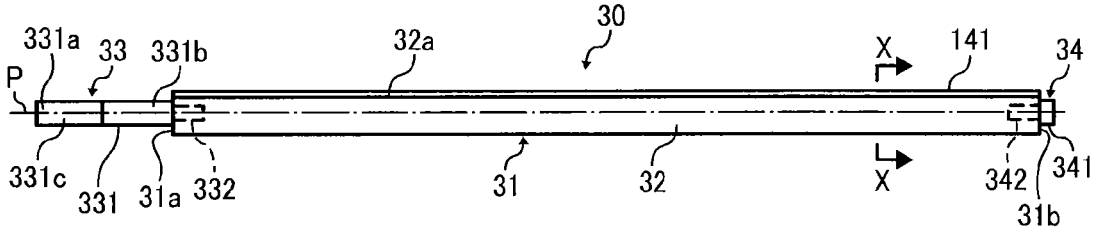
FIG. 2 is a side view of the magnet roller shown in FIG. 1.

FIG. 1 is a perspective view of a magnet roller 30 according to the present embodiment. FIG. 2 is a side view of the magnet roller 30 shown in FIG. 1, and FIG. 3 is a cross-sectional view along line X-X shown in FIG. 2.

Figure 3:
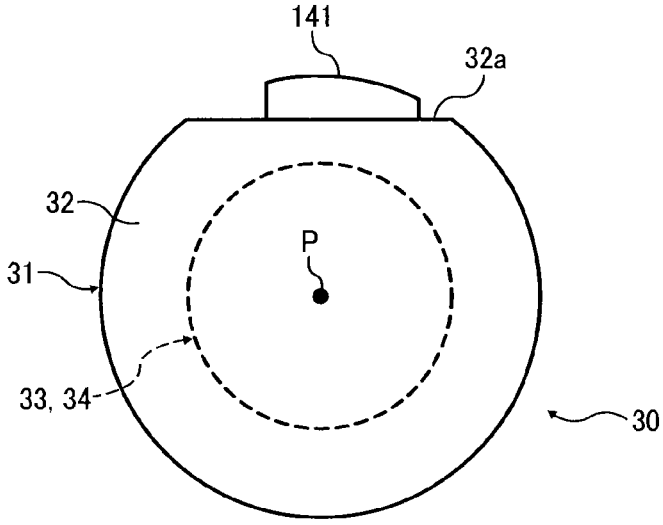
FIG. 3 is a cross-sectional view along line X-X shown in FIG. 2.

Referring to FIGS. 1 through 3, the magnet roller 30 according to the present embodiment includes a body 31 and a pair of support portions 33 and 34. It is to be noted that the magnet roller 30 can be incorporated in a development device 113 shown in FIG. 14. Specifically, the magnet roller 30 can be provided inside a development sleeve 132 (shown in FIG. 14), together forming a development roller 115.

It is to be noted that, in FIGS. 1 and 2, reference characters 31*a* and 31*b* represent end faces of the body 31.

The body 31 includes a roller body 32 constructed of a material capable of generating magnetic fields (hereinafter "magnetic field generating material") and a rare-earth magnet block 141. It is preferred that the roller body 32 be substantially cylindrical and have an external diameter smaller than 12 mm. The term "cylindrical" used here is not limited to round columns but also includes polygonal prisms.

Examples of the magnetic field generating material forming the roller body 32 include, but not limited to, so-called plastic magnet and rubber magnets, which are produced by mixing high polymer with magnetic powders. Examples of magnetic powders include strontium (Sr) ferrite and barium (Ba) ferrite. Examples of high polymers include polyamides such as Polyamide 6 (PA6) or Polyamide 12 (P12); ethylenes such as ethylene ethyl (EEA) copolymers or ethylene vinyl acetate (EVA); chlorinated polymers such as chlorinated polyethylene (CPE); and rubbers such as acrylonitrile butadiene rubber. Needless to say, other materials capable of generating magnetic fields than those listed above can be used unless they conflict intended effects of the present embodiment.

The circumferential surface of the roller body 32 includes a flat face 32*a* extending in the direction of an axis P (hereinafter "P-axis direction") of the roller body 32 over its long side entirely. That is, the roller body 32 is shaped as if a portion is cut out of a cylindrical shape along a chord of its circumference. The rare-earth magnet block 141 is fixed to the flat face 32*a*. With this configuration, the flat face 32*a* is provided with a main development pole extending over the long side of the roller body 32.

The shape of the body 31 is not limited to that illustrated in the drawings. Alternatively, for example, the body 31 may be constructed of a cylindrical body only, without the flat face 32*a*, made of a magnetic field generating material. Yet alternatively, instead of the flat face 32*a*, a groove extending over the entire length in the P-axis direction may be formed in the circumferential surface of the cylindrical roller body 32 constructed of a magnetic field generating material, and the rare-earth magnet block 141 may be inserted into the groove.

Additionally, the roller body 32 is provided with multiple stationary magnetic poles extending over the entire length of the roller body 32, each of which is either north (N) pole or south (S) pole. Those stationary magnetic poles are positioned in areas except the flat face 32*a* provided with the main development pole.

One of the stationary magnetic poles serves as a developer attracting pole or pump-up pole positioned facing an agitation screw 118 (shown in FIG. 14) of the development device 113. The developer attracting pole causes magnetic force on the outer surface of the development sleeve 132 (shown in FIG. 14) provided around the magnet roller 30. Then, developer contained in the developer container 117 of the development device 113 is adsorbed onto the outer surface of the development sleeve 132, being attracted by the magnetic force. That is, the developer attracting pole can pump up developer onto the outer surface of the development sleeve 132.

At least another one of the stationary magnetic poles serves as a conveyance pole and is positioned between the developer attracting pole and the main development pole provided to the flat face 32*a*, positioned downstream from the conveyance pole in the direction in which developer is transported by the development sleeve 132. The conveyance pole causes magnetic force on the outer surface of the development sleeve 132 for transporting developer (hereinafter "pre-development developer") that is not yet used for image development toward the photoreceptor drum 108.

The roller body 32 is further provided with a developer release pole for attenuating the magnetic force on the outer surface of the development sleeve 132, thereby causing developer to leave the development sleeve 132. The developer release pole is at substantially 180 degrees from the flat face 32*a*, that is, opposed to the flat face 32*a*. The developer release pole extends over the long side of the roller body 32.

The rare-earth magnet block 141 forms the main development pole when disposed on the flat face 32*a* of the roller body 32. The rare-earth magnet block 141 is shaped like a slim plate by magnetic field press or compression. Rare-earth magnets such as neodymium (Nd) magnet such as Nd—Fe—B or samarium (Sm) magnet such as Sm—Co and Sm—Fe—N can be used for the rare-earth magnet block 141 for attaining narrow range and high magnetic properties. Alternatively, the rare-earth magnet block 141 may be a plastic magnet or rubber magnet in which rare-earth magnetic powder is mixed with high polymer similarly to the roller body 32.

The pair of support portions 33 and 34 is constructed of a nonmagnetic material and is shaped like a cylinder or rod. The entire support portions 33 and 34 have an external diameter smaller than that of the body 31. The support portions 33 and 34 are fixed to the body 31 (the roller body 32 in particular) and project from the end faces 31*a* and 31*b* of the body 31.

In the present embodiment, the axis of the pair of support portions 33 and 34 (hereinafter also "first and second support portions 33 and 34") is aligned with the axis of the body 31 (axis P in FIGS. 2 and 3). Alternatively, the axes of the support portions 33 and 34 may be aligned with a line parallel, but not identical, to the axis P. Aligning the axis of the first support portion 33 with that of the second support portion 34 as in the present embodiment is advantageous to inhibit stress applied to the first and second support portions 33 and 34, and the body 31 from being unbalanced.

For example, the support portions 33 and 34 can be constructed of nonmagnetic Steel Use Stainless (SUS) such as SUS303, SUS304, or SUS316 according to Japanese Industrial Standards (HS). Alternatively, any nonmagnetic material may be used as long as the support portions 33 and 34 can be fixed to the body 31 and a sufficient degree of rigidity can be secured. For example, hard synthetic resin such as polycarbonate may be used.

Figure 4:
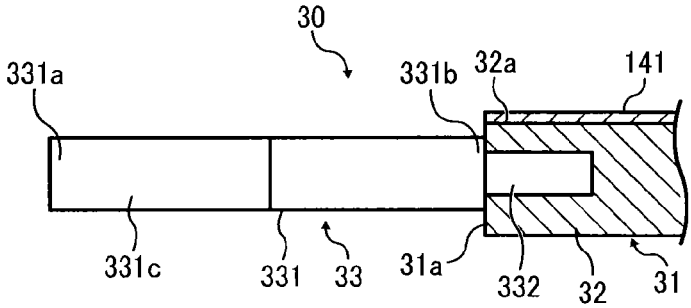
FIG. 4 is an enlarged side view illustrating a support portion on one side of the magnet roller and a cross section thereof.
Figure 5:
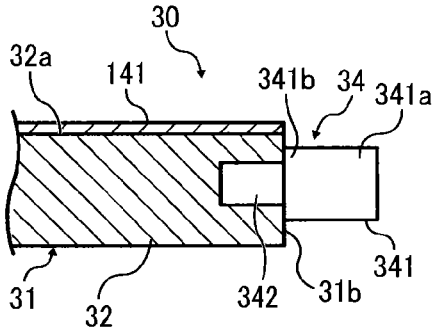
FIG. 5 is an enlarged side view illustrating a support portion on the other side of the magnet roller and a cross section thereof.

FIG. 4 is an enlarged side view illustrating the first support portion 33 of the magnet roller 30 and a cross section thereof. FIG. 5 is an enlarged side view illustrating the support portion 34 of the magnet roller 30 and a cross section thereof.

As shown in FIGS. 1, 2 and 4, one end of the first support portion 33 projects outside the end face 31*a* of the body 31, and the other end thereof is buried inside the body 31. That is, the first support portion 33 includes a projecting part 331 positioned outside the end face 31*a* and a buried part 332 (shown in FIG. 2) positioned inside the body 31 and continuous with the projecting part 331.

An end portion 331*a* of the projecting part 331 is shaped as if a cylindrical shape is partly cut away along a chord of its circumference. That is, the positioning face 331*c* is formed in the circumferential surface at the end of the projecting part 331.

The buried part 332 has an external diameter reduced from that of the base portion 331*b* of the projecting part 331 and hereinafter also called a reduced-area portion 332. In other words, the buried part (reduced-area portion) 332 has a cross-sectional area reduced from that of the base portion 331*b* of the projecting part 331 in the direction perpendicular to the axis P. It is to be noted that the shape of the buried part 332 is not limited to round columns but may be shaped like a polygonal cylinder such as a square cylinder or a hexagonal cylinder.

Referring to FIG. 5, similarly to the first support portion 33, the second support portion 34 includes a projecting part 341 and a buried part 342 continuous with the projecting part 341. The buried part 342 is cylindrical and has a cross-sectional area reduced from that of the projecting part 341.

Descriptions area given below of a method of manufacturing an intermediate product in which the roller body 32 and the support portions 33 and 34 are united together, that is, the magnet roller 30 without the rare-earth magnet block 141.

Figure 6:
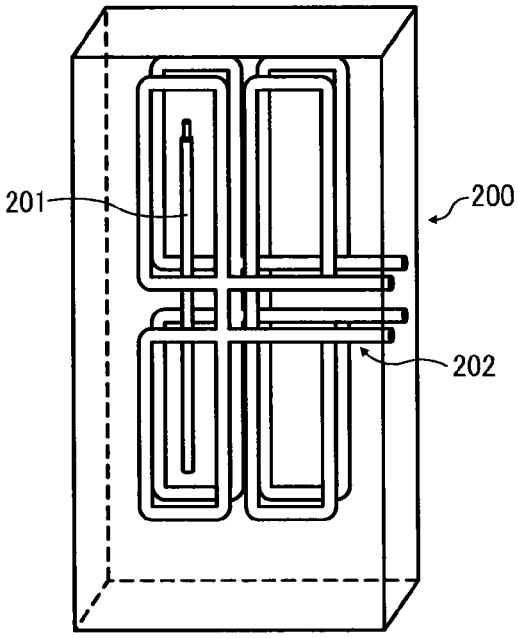
FIG. 6 is a schematic perspective view of a mold used in injection molding to produce the magnet roller shown in FIG. 1.
Figure 7:
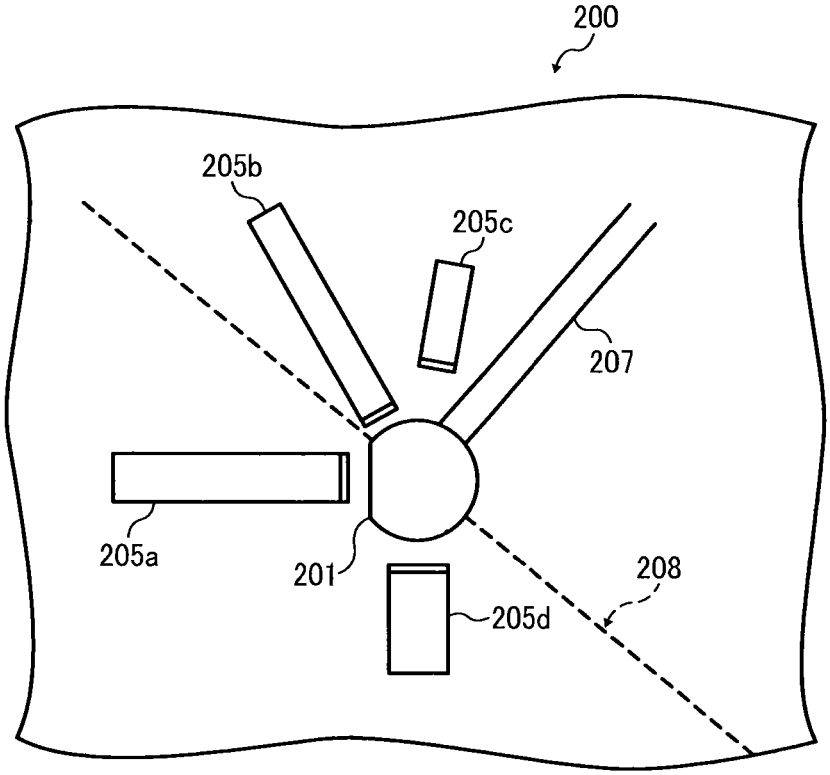

FIG. 6 is a schematic perspective view of a mold used in injection molding to produce the magnet roller shown in FIG. 1, and FIG. 7 schematically illustrates a configuration around a cavity of the mold shown in FIG. 7.

This intermediate product can be produced by insert and injection molding using a mold 200 shown in FIG. 6. In the mold 200, a cavity 201 conforming to the shape of the intermediate product and multiple channels 202 are formed. Cooling water flows through the channels 202 to cool materials for the roller body 32, put in the cavity 201.

Additionally, as shown in FIG. 7, permanent magnets 205*a* through 205*d* are arranged around the cavity 201 to give the roller body 32 magnetism for generating magnetic force on the outer surface of the development sleeve 132, by which developer is transported to the photoreceptor drum 108. It is to be noted that reference numeral 207 shown in FIG. 7 represents an ejection pin and 208 represents a divided face of the mold 200.

Shapes (width, height, and the like) and positions (i.e., the distance from the cavity 201) of the permanent magnets 205*a* through 205*d* are designed in accordance with the strength of magnetic force required at the respective stationary magnetic poles of the roller body 32. Even when the rare-earth magnet block 141 is relatively thin, high magnetic force similar to that of typical configurations can be attained by arranging the permanent magnets 205*a* through 205*d* such that a certain degree of orientation can be secured at the main development pole. It is to be noted that, to secure developer removal effect and the like, permanent magnets are also provided to other areas than those corresponding to the respective stationary magnetic poles.

Descriptions are given below of a configuration of the magnet roller 30 according to the present embodiment.

For example, the roller body 32 of the body 31 can be a plastic magnet constructed of anisotropic strontium ferrite, as the magnetic powder, and Polyamide 12 (P12), as the high polymer. For example, the roller body 32 is cylindrical and has an external diameter of 10 mm and a length of 223 mm. The flat face 32*a* of the roller body 32 has a width of 6 mm and a length of 223 mm. The flat face 32*a* is at a height of 5 mm from the center (axis P) of the roller body 32.

The rare-earth magnet block 141 is substantially planar and narrow, having a width of 3.5 mm, a peak height of 1.0 mm, and a length of 223 mm, for example. Further, a top face of the rare-earth magnet block 141 is curved at a radius of 5 mm (R5), for example. The rare-earth magnet block 141 can be bonded to the flat face 32*a* of the roller body 32 using glue or the like.

The pair of support portions 33 and 34 is constructed of SUS303 and fixed to the body 31 (the roller body 32 in particular) as a single unit by insertion and injection molding. The projecting part 331 of the first support portion 33 is cylindrical and has an external diameter of 6 mm and a length of 35 mm. The buried part 332 (reduced-area portion) is cylindrical and has an external diameter of 4 mm and a length of 10 mm. The projecting part 341 of the support portion 34 is cylindrical and has an external diameter of 6 mm and a length of 5 mm. The buried part 342 (reduced-area portion) is cylindrical and has an external diameter of 4 mm and a length of 10 mm.

The configuration of the magnet roller 30 is not limited to the description above.

Next, effects attained by the magnet roller 30 according to the present embodiment are described below.

Figure 18:
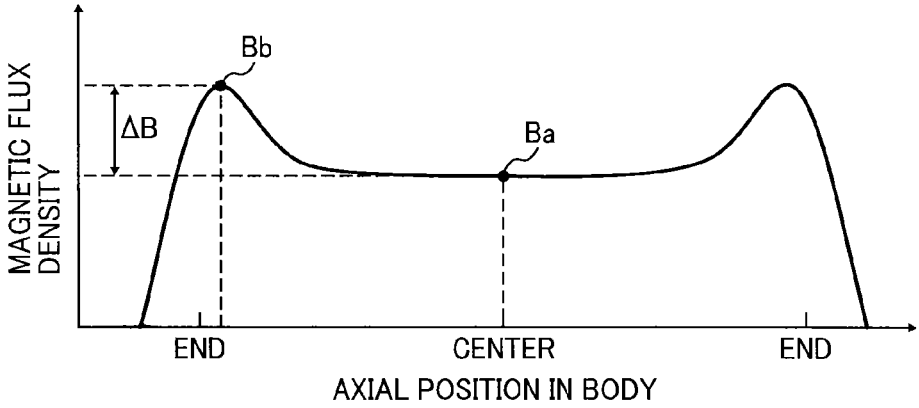
FIG. 18 is a graph illustrating the distribution of magnetic flux density on a circumferential surface of a magnet roller according to a first comparative example.

Initially, comparative examples are described. A magnet roller according to a first comparative example is produced by monolithic molding and includes a body and support portions provided on both sides thereof. Both of the body and the support portions are constructed of a magnetic field generating material such as resin magnet. In such magnet rollers, as shown in FIG. 18, the density of magnetic flux on the circumferential surface of the body tends to become uneven in the axial direction. Specifically, the magnetic flux density around the axial ends of the body tends to be higher than that in an axial center portion thereof, which is a phenomenon generally called "edge effects". The magnetic flux density used here means the density of magnetic flux in a normal direction to the circumferential surface of the body of the magnet roller. Edge effects can increase the density of portions of developed images corresponding to the axial ends of the body of the magnet roller, thus making the image density uneven.

Figure 19:
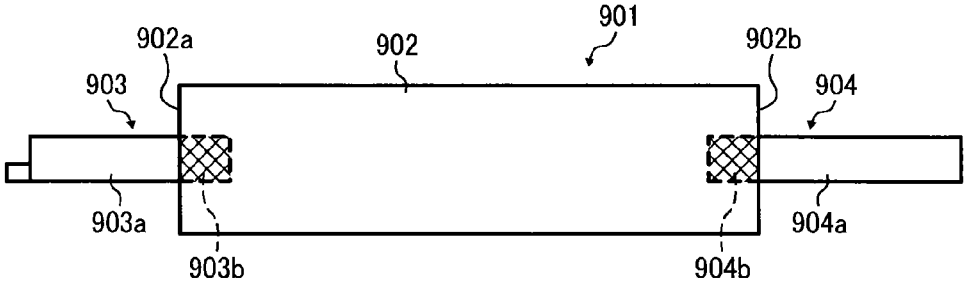
FIG. 19 is a side view of a magnet roller according to a second comparative example.

FIG. 19 illustrates a magnet roller 901 according to a second comparative example. The magnet roller 901 includes a cylindrical body 902 constructed of resin magnet and a pair of nonmagnetic support rods 903 and 904 (support portions) projecting from end faces 902*a* and 902*b* of the body 902.

The support rod 903 includes a projecting part 903*a* positioned outside the end face 902*a* of the body 902 and a buried part 903*b* positioned inside the body 902 and continuous with the projecting part 903*a*. Similarly, the support rod 904 includes a projecting part 904*a* and a buried part 904*b*. The buried parts 903*b* and 904*b* have a thickness or width identical to that of the projecting part 903*a* and 904*a*.

When the support rods 903 and 904 are constructed of a nonmagnetic material having a high rigidity, durability of the magnet roller 901 shown in FIG. 19 can improve. Additionally, burying the support rods 903 and 904 partly inside the body 902 can reduce the volume of the axial end portions of the body 902, thereby reducing the magnetic flux density. Accordingly, the above-described edge effects can be alleviated.

Figure 20:
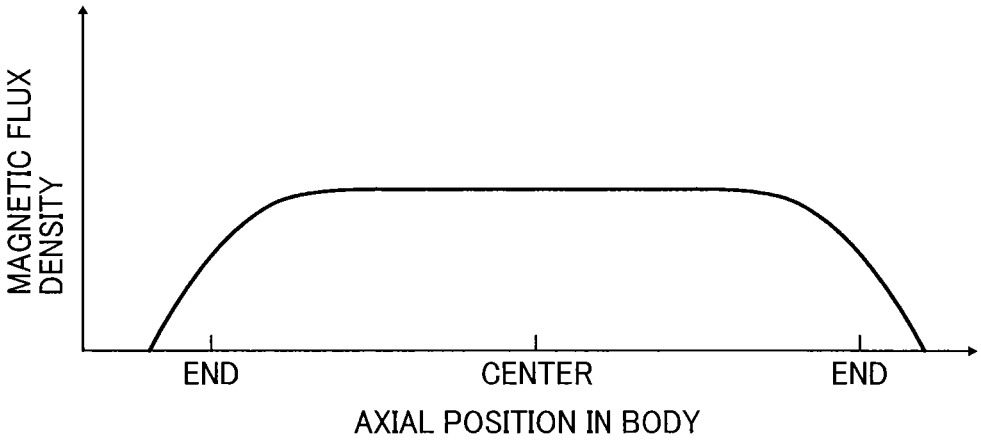
FIG. 20 is a graph illustrating the distribution of magnetic flux density on a circumferential surface of the magnet roller according to the second comparative example.
Figure 21:
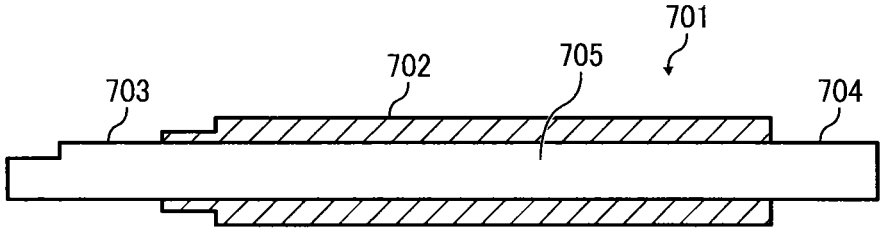
FIG. 21 RELATED ART
FIG. 21 is a cross-sectional view of a magnet roller according to a related art.
Figure 22:
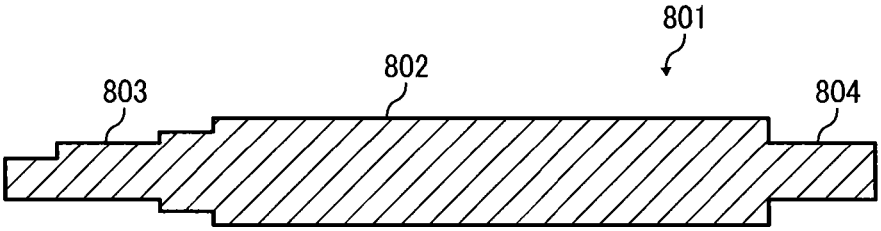
FIG. 22 RELATED ART
FIG. 22 is a cross-sectional view of a magnet roller according to another related art.

The volume of the end portions of the body 902, however, may be reduced excessively if the buried parts 903*b* and 904*b* are excessively long to secure the rigidity of the support rods 903 and 904. In this case, the volume of the resin magnet in the end portions is insufficient, and, as shown in FIG. 20, the magnetic flux density on the circumferential surface of the body is lower in the end portions than in the center portion.

Additionally, the thickness or width of the buried parts 903*b* and 904*b* is identical to that of the projecting parts 903*a* and 904*a*, which can also make the volume of the end portions of the body 902 insufficient. Accordingly, the magnetic flux density is lower in the end portions of the body 902 than in the center portion thereof.

In view of the foregoing, it is preferred to reduce differences in the magnetic flux density in the longitudinal direction (axial direction) of the magnet roller while securing a sufficient rigidity of the support portions.

In the magnet roller 30 according to the present embodiment, the support portions 33 and 34 are partly buried inside the body 31, and at least a part of the buried parts 332 and 342 of the support portions 33 and 34 are thinner than the projecting parts 331 and 341, that is, reduced in cross-sectional area from those of the projecting parts 331 and 341.

Accordingly, the volume of the buried parts 332 and 342 of the support portions 33 and 34 can be reduced from that of the comparative configuration in which the thickness of the buried parts are identical to that of the projecting parts.

Figure 8:
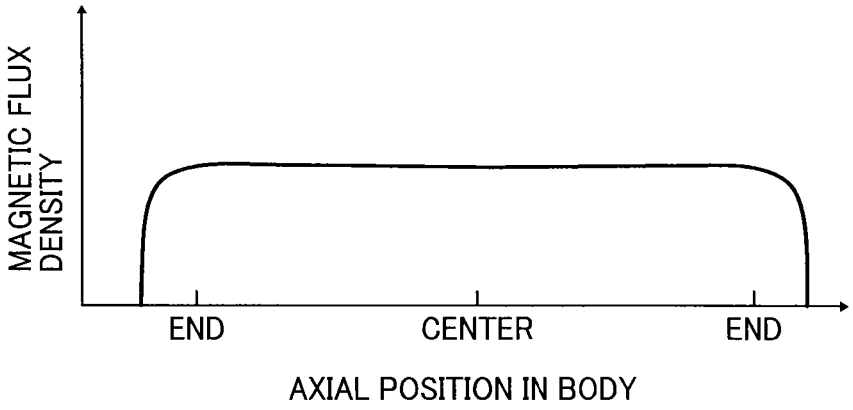
FIG. 8 is a graph that schematically illustrates an ideal distribution of the magnetic flux density on the outer circumferential surface of the magnet roller.

With this configuration, a sufficient volume of the axial end portions of the body 31 can be secured. Simultaneously, the volume of the axial end portions of the body 31 can be adjusted by changing the cross-sectional area of the buried parts 332 and 342 (reduced-area portions), that is, the volume thereof. This adjustment enables inhibition of edge effects. Accordingly, as shown in FIG. 8, the distribution of magnetic flux density can be closer to an ideal, and axial differences in magnetic flux density of the body 31 are reduced.

Additionally, a material having a high rigidity can be used for the support portions 33 and 34 to secure rigidity thereof since the material can be different from that of the body 31.

It is to be noted that the term "magnetic flux density" used here means the density of magnetic flux in the direction normal to the circumferential surface of the body 31 of the magnet roller 30 (or, in the area where the rare-earth magnet block 141 is provided, a virtual circumferential surface of the roller body 32 assuming that the roller body 32 is round in cross section).

The magnet roller 30 according to the present embodiment includes the roller-shaped body 31 constructed of the magnetic field generating material and the pair of rod-shaped, nonmagnetic support portions 33 and 34 provided to the axial end portions of the body 31. The support portions 33 and 34 respectively include the projecting parts 331 and 341 projecting from the end faces 31*a* and 31*b* of the body 31 and the buried parts 332 and 342 positioned inside the body 31 and continuous with the projecting parts 331 and 345. The cross section (perpendicular to the P-axis direction) of the buried parts 332 and 342 are reduced from that of the base portions 331*b* and 341*b* of the projecting part 331 and the 341. Although the entire buried parts 332 and 342 are reduced in cross section in the configuration shown in FIGS. 1 through 5, alternatively, at least a part of the buried parts 332 and 342 may be reduced in cross section from that of the projecting part 331 and the 341.

Additionally, in the configuration shown in FIGS. 1 through 5, the entire buried parts 332 and 342 are shaped like rods.

Both of the support portions 33 and 34 are aligned with the axis P of the body 31. This adjustment enables inhibition of edge effects and reduction of axial differences in magnetic flux density on the circumferential surface of the magnet roller 30.

Additionally, the rod-shaped buried parts (reduced-area portions) 332 and 342 can be designed and manufactured easily, thus facilitating inhibition of differences in magnetic flux density on the circumferential surface of the magnet roller 30.

Aligning the axes of the support portions 33 and 34 with the axis P of the body 31 is advantageous to inhibit stress applied to the support portions 33 and 34, and the body 31 from being unbalanced.

Although the entire reduced-area portions (buried parts 332 and 342) are cylindrical in the above-described configuration, the shapes thereof are not limited thereto. For example, FIGS. 9 through 12 illustrate variations of the reduced-area portions.

Figure 9:
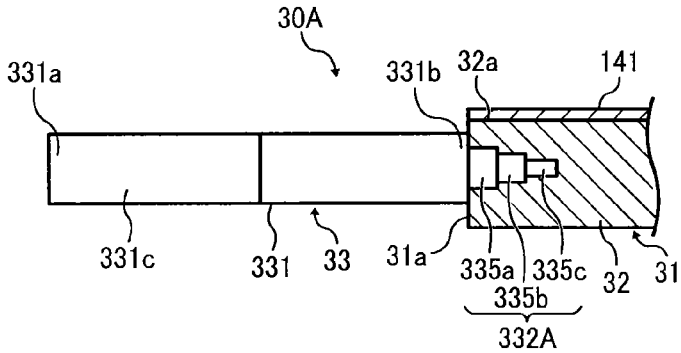
FIG. 9 is an enlarged side view of a magnet roller according to a first variation having a stepped reduced-area portion, with a partial cross section.

In a magnet roller 30A shown in FIG. 9 according to variation 1, a buried part 332A of a first support portion 33A includes multiple reduced-area portions 335*a*, 335*b*, and 335*c* different in external diameter, each of which is substantially cylindrical entirely. The reduced-area portions 335*a*, 335*b*, and 335*c* are arranged in the P-axis direction. It is preferable that the reduced-area portions 335*a*, 335*b*, and 335 are arranged such that the one having a larger cross-sectional area is closer to the projecting part 331. For example, the reduced-area portion may be shaped such that its cross-sectional area decreases stepwise with increasing distance from the projecting part 331.

Figure 10:
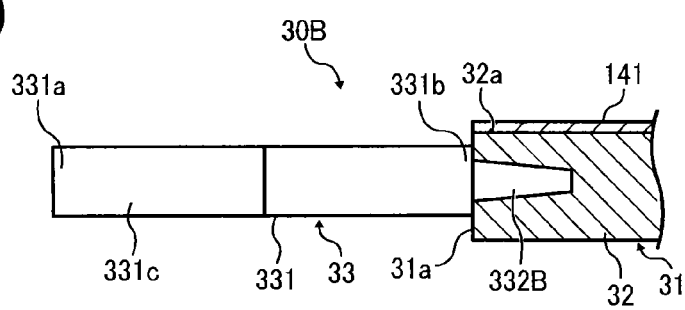
FIG. 10 is an enlarged side view of a magnet roller according to a second variation having a tapered reduced-area portion, with a partial cross section.

Alternatively, a magnet roller 30B shown in FIG. 10 according to variation 2 includes a first support portion 33B having a buried part 332B that is cylindrical and tapered. That is, the cross-sectional area of the buried part 332B decreases gradually with increasing distance from the projecting part 331. Although the entire buried part 332B is tapered, alternatively, a part of the buried part 332B may be tapered.

With the stepped reduced-area portion 332A shown in FIG. 9 or the tapered reduced-area portion 332B shown in FIG. 10, the rate of decrease of the volume of the body 31 can decrease stepwise or gradually as the position goes deeper inside the body 31 from the end face 31*a*. With this configuration, the volume of the body 31 can be reduced at a rate conforming to the rate of changes in the magnetic flux density due to edge effects, thereby better alleviating axial differences in magnetic flux density on the circumferential surface of the body 31.

Figure 11:
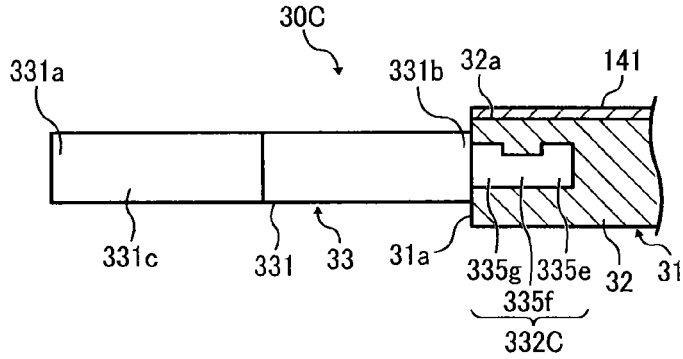
FIG. 11 is an enlarged side view of a magnet roller according to a third variation having a latch-shaped reduced-area portion, with a partial cross section.

Yet alternatively, FIG. 11 illustrates a magnet roller 30C according to variation 3. In FIG. 11, a buried part 332C of a first support portion 33C is cylindrical or rod-shaped entirely and includes first, second, and third portions 335*e*, 335*f*, and 335*g* connected together, forming a latch shape, and arranged in the P-axis direction. The first portion 335*e* is cylindrical and the third portion 335*g* is also cylindrical and identical or similar in cross-sectional area to the first portion 335*e*. The second portion 335*f* is shaped as if a part of a cylindrical shape is cut away along a chord of its circumference.

The following advantage can be attained in the configuration in which the buried part 332C has the latch shape constituted of the first portion 335*e* and the second portion 335*f* adjacent to the first portion 335*e* and smaller in cross section than the first portion 335*e*, and the first portion 335*e* is farther from the projecting part 331 than the second portion 335*f*. The body 31 can enter the step formed by the first and second portions 335*e* and 335*f*, engaging the buried part 332C. Thus, the body 31 can be latched, and the first support portion 33C can be inhibited from coming off from the body 31.

It is to be noted that, although the entire buried parts 332 and 342 are reduced in cross-sectional area and serve as the reduced-area portions in the above-described embodiment and variations, the buried parts 332 and 342 can be shaped otherwise.

Figure 12:
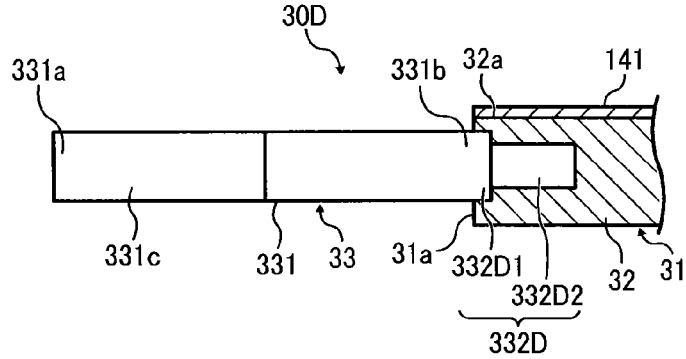
FIG. 12 is an enlarged side view of a magnet roller according to a fourth variation, in which a part of a buried part is identical in cross sectional shape to that of a projecting part, with a partial cross section.

For example, FIG. 12 illustrates a magnet roller 30D according to variation 4, in which a buried part 332D of a first support portion 33D includes a reinforcement 335D1 adjacent to the projecting part 331 and a reduced-area portion 335D2 adjacent to the reinforcement 335D1. The reinforcement 335D1 is cylindrical and identical or similar in cross-sectional area to that of the base portion 331*b* of the projecting part 331. The reduced-area portion 335D2 is cylindrical having a cross-sectional area reduced from that of the reinforcement 335D1.

When the buried part 332D has the reinforcement 335D1 identical in thickness to the base portion 331*b* of the projecting part 331, the first support portion 33 can has an increased rigidity. The axial length of the reinforcement 335D1 depends on the configuration of the magnet roller 30. For example, even if the axial length of the reinforcement 335D1 is 1 mm or 2 mm, the rigidity of the first support portion 33 can improve.

It is to be noted that, although FIGS. 9 through 12 illustrate the support portion on only one side, the support portion on the other side may be configured similarly. Additionally, the configurations shown in FIGS. 9 through 12 can be combined.

Further, although the pair of support portions 33 and 34 is nonmagnetic in the above-described configurations, alternatively, only one of the support portions 33 and 34 may be nonmagnetic, whereas the other support portion 33 or 34 may be constructed of the magnetic field generating material identical for the roller body 32 of the body 31 and integrated with the roller body 32. In other words, at least one of the support portions on the respective sides of the body is constructed of a nonmagnetic material, and the buried part of that support portion includes the reduced-area portion.

It is to be noted that, although the entire reduced-area portion is cylindrical or rod-shaped, the reduced-area portion can be shaped otherwise. For example, the entire buried portion may be shaped into a sphere having a diameter smaller than the external diameter of the base portion of the projection part of the support portion, and an outer surface thereof is partly connected to the projecting part.

Descriptions are given below of the development roller 115 serving as the developer bearer according to an embodiment.

Figure 13:
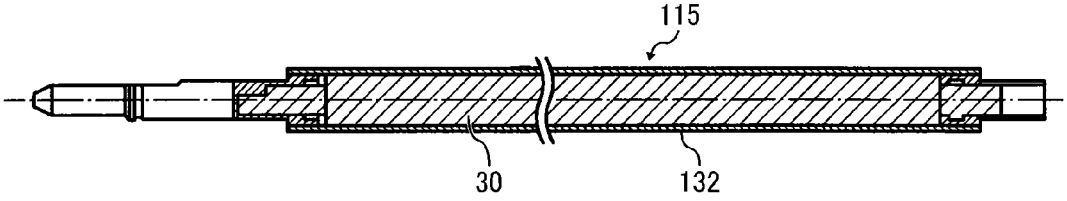
FIG. 13 is a cross-sectional view illustrating a development roller serving as a developer bearer according to an embodiment.

FIG. 13 is a cross-sectional view illustrating a development roller serving as a developer bearer according to an embodiment. As shown in FIG. 13, the development roller 115 includes the above-described magnet roller 30 and the development sleeve 132 serving as a hollow member. The magnet roller 30 is disposed on an inner circumferential side of the development sleeve 132 not to contact an inner circumferential surface of the development sleeve 132. The support portions 33 and 34 of the magnet roller 30 are fixed to the casing 125 of the development device 113.

The development sleeve 132 is nonmagnetic and rotatable around an axis of the development roller 115. While rotating, a part of the development sleeve 132 faces the main development pole and the respective stationary magnetic poles sequentially. The development sleeve 132 can be constructed of aluminum, Steel Use Stainless (SUS), or the like. As the material of the development sleeve 132, aluminum alloy excels in its lightness and easiness in processing. A6063, A5056, and A3003 are preferable as aluminum alloy. When stainless steel is used, SUS303, SUS304, and SUS316 are preferable.

Since the development roller 115 incorporates the above-described magnet roller 30, differences in magnetic flux density in the long size direction of the development sleeve 132, in particularly, the magnet roller 30, thus alleviating image density unevenness in the long side direction. Additionally, the rigidity of the magnet roller 30 of the development roller 115 can be secured, which can improve the durability of the development roller 115.

The development device 115 according to an embodiment is described with reference to FIGS. 14 and 15.

Figure 14:
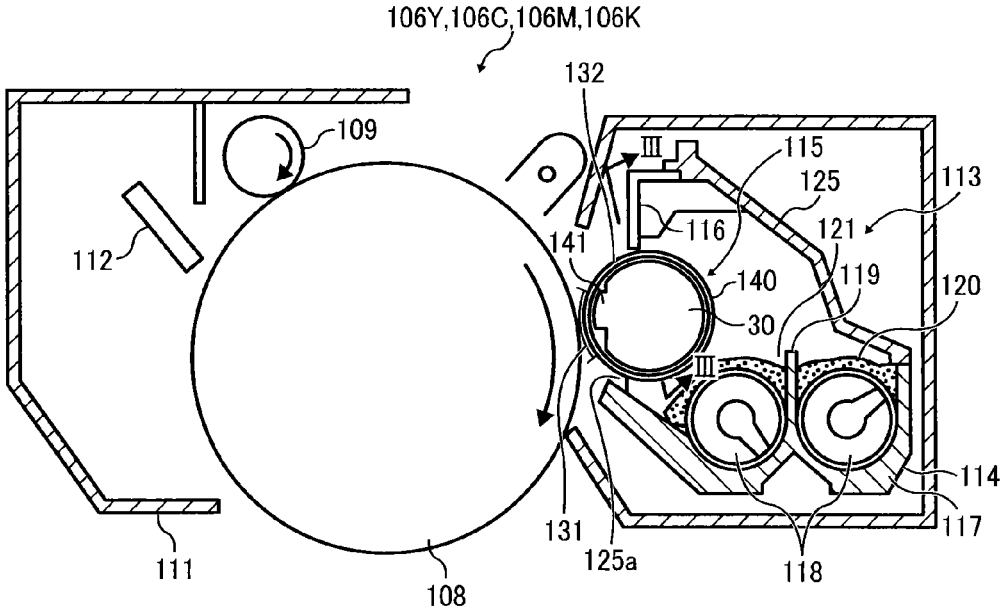
FIG. 14 is an end-on axial view of a process cartridge incorporating a development device employing a magnet roller according to an embodiment.

FIG. 14 is an end-on axial view of a process cartridge incorporating a development device employing the magnet roller according to any of the above-described embodiments. FIG. 15 is a cross-sectional view of magnetic carrier (magnetic carrier particle) contained in developer usable in the development device shown in FIG. 14.

As shown in FIG. 14, the development device 113 includes a developer supply unit 114, a casing 125, a doctor blade 116, and the above-described development roller 115 serving as a developer bearer.

The developer supply unit 114 includes a developer container 117, a supply screw 118*a* serving as a developer agitator, and a conveyance screw 118*b*. The supply screw 118*a* and the conveyance screw 118*b* are hereinafter also collectively referred to as agitation screws 118. For example, the developer container 117 is shaped like a box and has an axial length (i.e., a length in its longitudinal direction) equal or similar to an axial length of the photoreceptor drum 108. Additionally, a partition 119 extending in the longitudinal direction of the developer container 117 is provided inside the developer container 117. The partition 119 divides the developer container 117 into a first compartment 120 and a second compartment 121 that communicate with each other in both end portions in the longitudinal direction.

Developer is contained in both the first compartment 120 and the second compartment 121 of the developer container 117. Developer (illustrated in FIG. 15) usable in the present embodiment is two-component developer consisting essentially of toner (toner particles) and magnetic carrier (magnetic carrier particles) 135. Fresh toner is supplied as required to either of axial end portions of the first compartment 120, which is positioned on the front side of the paper on which FIG. 14 is drawn, farther from the development roller 115 than the first compartment 121 is.

For example, toner particles are spherical fine particles produced through an emulsion polymerization method or a suspension polymerization method. It is to be noted that, alternatively, toner may be produced by smashing synthetic resin blocks in which various colorants and pigments are mixed or dispersed. The toner particles have a mean particle diameter of within a range from about 3 μm to 7 μm. Alternatively, toner may be produced by pulverization.

Figure 15:
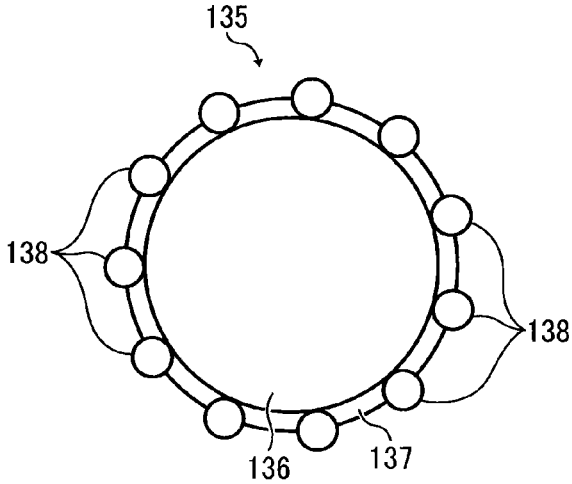
FIG. 15 is a cross-sectional view of magnetic carrier (magnetic carrier particle) contained in developer usable in the development device shown in FIG. 14.

The magnetic carrier 135 includes a core 136 coated with a resin coat 137, and alumina particles 138 are dispersed in the resin coat 137 as shown in FIG. 15. For example, the magnetic carrier 135 has a mean particle diameter of within a range from about 20 μm to 50 μm. The magnetic carrier 135 is contained in both the first and second compartments 120 and 121.

The core 136 is spherical and constructed of a magnetic material such as ferrite. The core 136 is covered with the resin coat 137 entirely. For example, the resin coat 137 contains a charge adjuster and a resin component, such as acrylic resin, in which thermoplastic resin and melamine resins are bridged together. The resin coat 137 is elastic and has a high degree of adhesion force. The alumina particles 138 are spherical and have an external diameter greater than the thickness of the resin coat 137. The alumina particles 138 are held by the adhesion force of the resin coat 137. The alumina particles 138 project outward from the outer face of the resin coat 137.

The agitation screws 118 are provided in the first and second compartments 120 and 121, respectively. The long axes of the agitation screws 118 parallel the longitudinal direction of the developer container 117, the development roller 115, and the photoreceptor drum 108. Each agitation screw 118 is rotatable about an axis of rotation. Each agitation screw 118 mixes the toner with the magnetic carrier and transports the developer in the axial direction while rotating.

In the configuration shown in the figures, the conveyance screw 118 in the first compartment 120 transports the developer from the axial end portion to which the toner is supplied to the other axial end portion (on the back side of the paper on which FIG. 14 is drawn). The agitation screw 118 in the second compartment 121 transports the developer in the direction opposite the direction in which the developer is transported (hereinafter "developer conveyance direction") in the first compartment 120.

In the above-described configuration, while mixing the supplied toner and the magnetic carrier 135, the developer supply unit 114 transports toner from one end to the other end of the first compartment 120 and further to an upstream end portion of the second compartment 121 in the developer conveyance direction therein. Toner and the magnetic carrier 135 in the developer are further mixed in the second compartment 121. Then, the developer is supplied to the surface (i.e., the circumferential surface) of the development roller 115 while transported it in the axial direction thereof.

The casing 125 is box-shaped and is attached to the developer container 117 of the developer supply unit 114. The casing 125 and the developer container 117 together cover the development roller 115 and the like. Additionally, an opening 125*a* is provided in a portion of the casing 125 facing the photoreceptor drum 108.

The development roller 115 is positioned between the second compartment 121 and the photoreceptor drum 108, adjacent to the opening 125*a*, with the support portions 33 and 34 of the magnet roller 30 fixed to the casing 125. The development roller 115 parallels both the photoreceptor drum 108 and the developer container 117. As described above, the development roller 115 is positioned across the predetermined gap from the photoreceptor drum 108.

The doctor blade 116 is provided in an end portion of the development device 113, on the side of the photoreceptor drum 108. The doctor blade 116 attached to the casing 125 at a position across a gap from the surface of the development sleeve 132. The doctor blade 116 removes the developer from the development sleeve 132 when the amount is excessive, that is, the thickness exceeds a predetermined thickness, and returns the excessive developer to the developer container 117, thereby adjusting the amount of developer conveyed to the development area 131.

After toner and the magnetic carrier 135 therein are agitated sufficiently in the developer supply unit 114, the developer is attracted to the surface of the development sleeve 132 by the magnetic force exerted by the stationary magnetic poles. The development sleeve 132 rotates and conveys the developer attracted to the surface thereof by the multiple magnetic poles to the development range 131. Then, the doctor blade 116 adjusts the amount of the developer carried on the development sleeve 132, and then the developer is attracted to the photoreceptor drum 108. Thus, developer is carried on and transported by the development roller 115 to the development area 131, and then develops the latent image formed on the photoreceptor drum 108 into the toner image.

Further, the developer used in image development is separated from the development roller 115 and returned to the developer container 117. The used developer is agitated with the developer contained in the second compartment 121 of the developer container 117 and is again used to develop the latent image formed on the photoreceptor drum 108.

Since the development device 113 incorporates the above-described development roller 115, differences in magnetic flux density in the long size direction of the development sleeve 132, in particularly, the magnet roller 30, thus alleviating image density unevenness in the long side direction. Additionally, the rigidity of the magnet roller 30 of the development roller 115 can be secured, which can improve the durability of the development device 113.

The process cartridge 106 according to an embodiment is described with reference to FIG. 14.

In the configuration shown in FIG. 14, the process cartridge 106 includes a cartridge casing 111, a charge roller 109 serving as a charge member, the photoreceptor drum 108, a cleaning blade 112 serving as a cleaning member, and the development device 113.

The cartridge casing 111 is removably insertable into an apparatus body 102 and houses the charge roller 109, the photoreceptor drum 108, the cleaning blade 112, and the development device 113. The charge roller 109 charges the surface of the photoreceptor drum 108 uniformly. The photoreceptor drum 108 is positioned across a gap from a development roller 115 of the development device 113. The photoreceptor drum 108 is shaped like a round or polygonal column and rotatable about an axis. Electrostatic latent images are formed on the outer surface of the photoreceptor drum 108 by optical writing. The development device 113 develops the latent image into toner image with toner. Then the toner image is transferred from the photoreceptor drum 108 onto a sheet of recording media. The cleaning blade 112 removes any toner remaining on the surface of the photoreceptor drum 108 after image transfer.

Since the process cartridge 106 incorporates the above-described development device 113, differences in magnetic flux density in the long size direction of the development sleeve 132, in particularly, the magnet roller 30, thus alleviating image density unevenness in the long side direction. Additionally, the rigidity of the magnet roller 30 of the development roller 115 can be secured, which can improve the durability of the process cartridge 106.

The image forming apparatus according to an embodiment is described with reference to FIG. 16.

Figure 16:
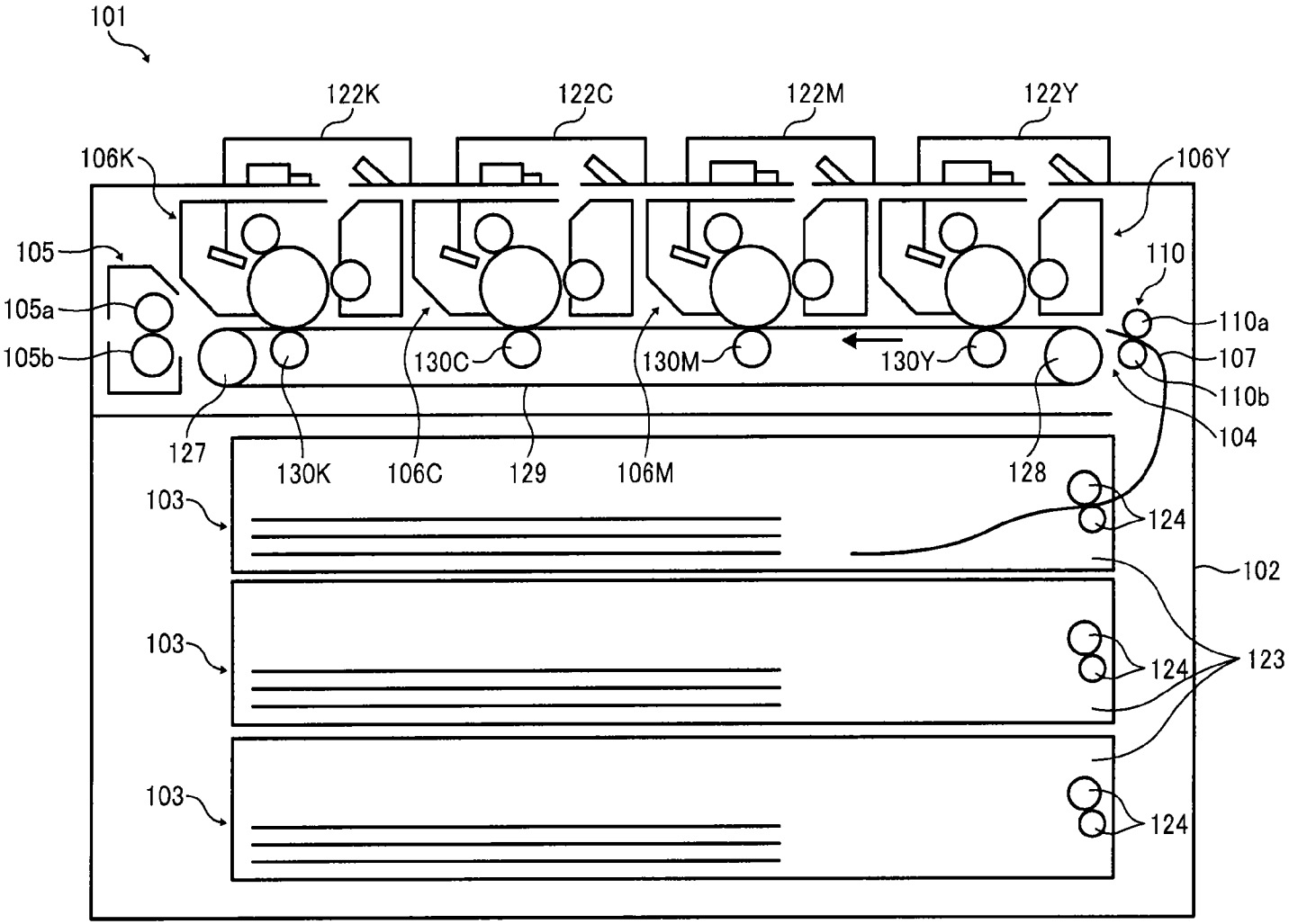
FIG. 16 is a schematic view of an image forming apparatus according to an embodiment of the present invention.

FIG. 16 is a schematic view of an image forming apparatus 101 according to an embodiment of the present invention.

The image forming apparatus 101 forms multicolor images on sheets 107 of recording media by superimposing yellow (Y), magenta (M), cyan (C), and black (K) single color images one on another. It is to be noted that that the suffixes Y, M, C, and K attached to the end of each reference numeral indicate only that components indicated thereby are used for forming yellow, magenta, cyan, and black images, respectively, and hereinafter may be omitted when color discrimination is not necessary.

As shown in FIG. 16, the Image forming apparatus 101 includes an apparatus body 102, a sheet feeder 103, a pair of registration rollers 110*a* and 110*b* (hereinafter also simply "the pair of registration rollers 110"), a transfer unit 104, a fixing device 105, multiple laser writing units 122, and multiple process cartridges 106.

The apparatus body 102 is shaped like a box, and is installed on the floor, for example. The apparatus body 102 contains the sheet feeder 103, the pair of registration rollers 110, the transfer unit 104, the fixing device 105, the multiple laser writing units 122, and the multiple process cartridges 106.

For example, multiple sheet feeders 103 are provided in a lower portion of the main body 102. The sheet feeder 103 includes a sheet cassette 123 for containing multiple recording sheets 107 that can be pulled out from and retracted into the main body 102 and a feed roller 124. The feed roller 124 is pressed against the recording sheet 107 on the top in the sheet cassette 123.

The pair of registration rollers 110 is positioned in a conveyance path through which the sheet 107 is fed from the sheet feeder 103 to the transfer unit 104. The pair of registration rollers 110 clamps the sheet 107 therebetween and forwards the recording sheet 107 to the nips between the process cartridges 106 and the transfer unit 104, timed to coincide with the arrival of the image to be transferred onto the sheet 107.

The transfer unit 104 is positioned above the sheet feeders 103 and includes a driving roller 127, a driven roller 128, the conveyance belt 129, and transfer rollers 130. The driving roller 127 is positioned on a downstream side in a sheet conveyance direction and driven by a driving source such as a motor. The driven roller 128 is rotatably supported by the apparatus body 102 and positioned on an upstream side in the sheet conveyance direction. The conveyance belt 129 is an endless belt and stretched around the driving roller 127 and the driven roller 128. As the driving roller 127 rotates, the conveyance belt 129 rotates around the driving roller 127 and the driven roller 128 counterclockwise in FIG. 16.

Each transfer roller 130 is positioned facing via the conveyance belt 129 the photoreceptor drum 108 of the corresponding process cartridge 106, and the sheet 107 is nipped therebetween. The transfer rollers 130 press the sheet 107, which is fed from the sheet feeder 103, against the photoreceptor drums 108 of the respective process cartridges 106, thereby transferring the toner images from the photoreceptor drums 108 onto the sheet 107. Then, the transfer unit 104 forwards the sheet 107 to the fixing device 105.

The fixing device 105 is positioned downstream from the transfer unit 104 in the sheet conveyance direction and includes a pair of rollers 105*a* and 105*b* that clamps the recording sheet 107 therebetween. The fixing device 105 fixes the toner image on the sheet 107, clamped between the rollers 105*a* and 105*b*, with heat and pressure.

The laser writing units 122Y, 122M, 122C, and 122K are positioned in an upper portion of the image forming apparatus 101 and provided for the process cartridges 106Y, 106M, 106C, and 106K, respectively. The laser writing units 122 direct laser beams onto the surfaces of the photoreceptor drums 108 in the respective process cartridges 106, thus forming electrostatic latent images thereon after charge rollers 109 charge the surfaces of the photoreceptor drums 108 uniformly.

The process cartridges 106 are positioned between the transfer unit 104 and the respective laser writing units 122. The process cartridges 106 are removably insertable into the apparatus body 102 and disposed parallel to each other in the sheet conveyance direction.

In the image forming apparatus 101, images can be formed as follows. Initially, the photoreceptor drum 108 starts rotating, and the charge roller 109 charges the surface of the photoreceptor drum 108 uniformly. Then, the laser writing units 122 direct the laser beams onto the surfaces of the photoreceptor drums 108, thus forming electrostatic latent images thereon. When the latent image is conveyed to a development range 131 (shown in FIG. 14) by the photoreceptor drum 108, developer carried on the development sleeve 132 of the development device 113 is adsorbed onto the surface of the photoreceptor drum 108, thereby developing the latent image formed thereon into a toner image.

The toner images are then transferred onto the sheet 107 when the sheet 107 transported by the feed roller 124 and the like of the sheet feeder 103 arrives at positions between the photoreceptor drums 108 and the conveyance belt 129. The image is fixed by the fixing device 105 on the recording sheet 107, and thus the image forming apparatus 101 forms the multicolor image thereon.

Since the image forming apparatus 101 incorporates the above-described process cartridges 106, differences in magnetic flux density in the long size direction of the development sleeve 132, in particularly, the magnet roller 30, thus alleviating image density unevenness in the long side direction. Additionally, the rigidity of the magnet roller 30 of the development roller 115 can be secured, which can improve the durability of the image forming apparatus 101.

Descriptions are given below of evaluation of the magnet rollers according to the above-described embodiment, its variations, and comparative examples, different in shape, produced by injection molding.

In the evaluation, axial differences in the magnetic flux density on the body of the magnet roller, the amount by which the support portion shifts, and image density unevenness were measured. In the description below, configuration 1 corresponds to the above-described embodiment, and it is assumed that variations 1, 2, and 3 are within the scope of the embodiment in a broad sense.

The magnet rollers evaluated were produced under molding conditions (resin temperature, mold temperature, injection time, pressure, pressuring time, and cooling time) below.

TABLE 1

| Resin temperature | Mold temperature | Injection time | Pressure | Pressuring time | Cooling time |
|---|---|---|---|---|---|
| 300° C. | 80° C. | 0.8 sec | 60 MPa | 4 sec | 35 sec |

(Configuration 1)

As shown in FIGS. 1 through 3, in configuration 1, the roller body 32 of the body 31 is substantially cylindrical and constructed of plastic magnet compound of anisotropic strontium (Sr) ferrite and PA12 (manufactured by Toda Kogyo Corp.). The roller body 32 has an external diameter of 10 mm and an axial length of 223 mm. The flat face 32*a* has a width of 6.0 mm and an axial length of 223 mm, and a height of the flat face 32*a* from the axis P (i.e., center of the roller body 32) is 4.0 mm.

The first support portion 33 is rod-shaped and made of SUS303. The first support portion 33 is partly buried in the body 31 (inside the end face 31*a*) and united integrally thereto by injection molding. The second support portion 34 is formed integrally by injection molding and constructed of a material identical to that of the roller body 32. As shown in FIG. 4, the projection 331 of the first support portion 33 is cylindrical and has an external diameter of 6 mm and a length of 35 mm. The buried part (reduced-area portion) 335 is cylindrical and has an external diameter of 4 mm and a length of 10 mm. The second support portion 34 is cylindrical and has an external diameter of 6 mm and an axial length of 5 mm in the portion projecting from the end face 31*b* of the body 31. The rare-earth magnet block 141 is substantially planar and narrow, having a width of 3.5 mm, a peak height of 1.0 mm, a length of 223 mm, and an outer surface R5, for example. The rare-earth magnet block 141 is bonded to the flat face 32*a* of the roller body 32. Thus, in the magnet roller 30 of configuration 1, the buried part 332 is a single cylindrical element.

(Variation 1)

As described above, the magnet roller 30A according to variation 1, shown in FIG. 9, has the buried part 332A constructed of the three reduced-area portions 335*a*, 335*b*, and 335*c*, each of which has an axial length of 3 mm and is different in external diameter from each other. The reduced-area portions 335*a*, 335*b*, and 335*c* have external diameters of 4 mm, 3 mm, and 2 mm, respectively, and are arranged in the order in which the external diameter decreases with increasing distance from the projecting part 331. Other than that, the magnet roller 30A is similar to the configuration 1 described above. In other words, the magnet roller 30A has the stepped buried part 332A.

(Variation 2)

As described above with reference to FIG. 10, the magnet roller 30B according to variation 2 includes the tapered buried part 332B. The external diameter of the buried part 332B is 4 mm at the base end adjacent to the projecting part 331 and 2 mm at the end away from the projecting part 331. Other than that, the magnet roller 30B is similar to the configuration 1 described above.

(Variation 3)

As described above with reference to FIG. 11, the magnet roller 30C according to variation 3 includes the buried part 335C that is cylindrical or rod-shaped entirely and includes the first, second, and third portions 335*e*, 335*f*, and 335*g* connected together and arranged in the P-axis direction. The first and third portions 335*e* and 335*g* are cylindrical. The axial lengths of the first and third portions 335*e* and 335*g* are 5 mm and 3 mm, respectively. Although the first, second, and third portions 335*e*, 335*f*, and 335*g* and have an external diameter of 3 mm, the second portion 335*f* is shaped as if the cylindrical shape is partly cut away to a depth of 1 mm along the chord of its circumference. In other words, the magnet roller 30C has the latch-shaped buried part 332A for preventing relative rotation and disengagement between the buried part 332C and the body 31.

Comparative Example 1

In the magnet roller according to comparative example 1, one of the support portions (i.e., the first support portion) is integrated with the roller body 32 by injection molding and made of a material identical to that of the roller body 32. The first support portion projects 35 mm from the end face 31*a* of the body 31 and has an external diameter of 6 mm. Other than that, the comparative example is similar to the above-described configuration 1. That is, in the magnet roller according to comparative example 1, the body and the pair of support portions are formed as a single unit.

Comparative Example 2

In the magnet roller according to comparative example 2, similarly to the one shown in FIG. 19, the buried portion of the first support portion is cylindrical and has an external diameter of 6 mm and an axial length of 10 mm. Other than that, the comparative example 2 is similar to the above-described configuration 1. In comparative example 2, the thickness of the entire first support portion is constant. That is, the buried part and the projecting part are identical in thickness.

Comparative Example 3

In the magnet roller according to comparative example 3, the first support portion is constructed of SUM steel (JIS standard) sulfur-containing free-cutting steel. Other than that, the comparative example 3 is similar to the above-described configuration 1. That is, in comparative example 3, the first support portion is magnetic.

(Evaluation of Differences in Magnetic Flux Density)

The magnetic flux density was measured while a probe for measuring magnetic flux density, disposed close to the main development pole (i.e., the rare-earth magnet block) of the magnet roller, was moved along the axis P from an axial center of the magnet roller to one end where the first support portion was provided. A magnetic flux density Ba at the axial center is deducted from a maximum magnetic flux density Bb among the measured values, thereby obtaining a difference ΔB, which was evaluated according to the following criterion. When there is no value greater than the magnetic flux density Ba at the axial center, a difference (absolute value) between the magnetic flux density Ba and a value measured at one end of the body of the magnet roller was regarded as the difference ΔB.

Excellent: the difference in magnetic flux density is lower than 5 mT,

Good: the difference in magnetic flux density is lower than 6 mT, and

Bad: the difference in magnetic flux density is greater than 6 mT (Evaluation of Shift Amount of the First Support Portion)

The magnet roller was incorporated into the image forming apparatus according to the above-described embodiment and removed therefrom after 200,000 (two hundred thousand) sheets were output. Then, the amount by which the tip of the first support portion was shifted in the direction perpendicular to the axial direction from an initial position (where the tip was before 200,000 sheets were output) was measured. The shift amount of the first support portion was measured according to the following criterion.

Good: The shift amount is less than 5 μm, and

Bad: The shift amount is 5 μm or greater (Evaluation of image density unevenness)

After solid images were printed on A4-size sheets using the above-described image forming apparatus, image density unevenness was evaluated according to the following criterion.

Good: Image density unevenness in the axial direction of the magnet roller is not observed visually.

Bad: Image density unevenness in the axial direction of the magnet roller is observed visually.

Descriptions are given below of overall evaluation of the embodiment, the variations thereof, and the comparative examples in view of the above-described difference in magnetic flux density, the shift amount of the first support portion, and image density unevenness.

Good: no item is deemed bad, and

Bad: One or greater items are deemed bad

Respective configurations and evaluation results are shown in Table 2 below.

TABLE 2

| | Body-support portion Unification | Material of support portion | Buried part shape | Difference in magnetic flux density | Shift amount of support portion | Image density | Total |
|---|---|---|---|---|---|---|---|
| Configuration 1 | Insert and injection molding | Nonmagnetic (SUS303) | Cylindrical (reduced from projecting part) | 4.5 mT Excellent | 2.2 μm Good | Good | Good |
| Variation 1 | Insert and injection molding | Nonmagnetic (SUS303) | Stepped | 5.0 mT Good | 2.9 μm Good | Good | Good |
| Variation 2 | Insert and injection molding | Nonmagnetic (SUS303) | Tapered | 5.5 mT Good | 3.3 μm Good | Good | Good |
| Variation 3 | Insert and injection molding | Nonmagnetic (SUS303) | Cylindrical (reduced from projecting part with groove) | 4.5 mT Excellent | 2.3 μm Good | Good | Good |
| Comparative example 1 | Monolithic molding | Magnetic field generating material (Plastic magnet) | — | 10.0 mT Bad | 12.4 μm Bad | Bad | Bad |
| Comparative example 2 | Insert and injection molding | Nonmagnetic (SUS303) | Cylindrical (diameter is identical to that of projecting part) | −7.5 mT Bad | 2.0 μm Good | Bad | Bad |
| Comparative example 3 | Insert and injection molding | Magnetic material (SUM) | Cylindrical (reduced from projecting part with groove) | 12.5 mT Bad | 2.1 μm Good | Bad | Bad |

In Table 2, "Image density" means uniformity of image density, and "Total" means total evaluation.

From Table 2, the following can be known.

In comparative example 1, since the first support portion is constructed of plastic magnet used for the body and integrated as a single unit with the body, axial differences in the magnetic flux density on the circumferential surface of the body are greater, causing image density unevenness. Further, the shift amount of the first support portion is greater, meaning that the rigidity is not sufficient.

In comparative example 2, since the projecting part and the buried part of an identical support portion have an identical thickness, the magnetic flux density at the axial end portion is smaller than the axial center portion, thereby causing image density unevenness.

Additionally, in comparative example 2, since the first support portion is magnetic, axial differences in the magnetic flux density on the circumferential surface of the body are greater, thereby causing image density unevenness.

By contrast, in the above-described embodiment and its variations, the first support portion is nonmagnetic, and at least a part of the buried portion thereof (reduced-area portion) is smaller in cross-sectional area than the base end portion of the projecting part. Accordingly, the volume of the first axial end portion of the body can be adjusted to inhibit edge effect, thereby keeping the axial differences in the magnetic flux density on the body within a suitable range. Thus, image density unevenness can be alleviated. Additionally, when the first support portion is constructed of a nonmagnetic material (such as SUS303) having high rigidity, the shift amount of the first support portion can be reduced, securing the rigidity.

From the evaluation results, it can be known that the embodiment and its variations can reduce edge effects and axial differences in the magnetic flux density of the magnet roller, and that a material having a high rigidity can be used for the support portions 33 and 34 to secure rigidity thereof since the material can be different from that of the body 31.

Figure 17:
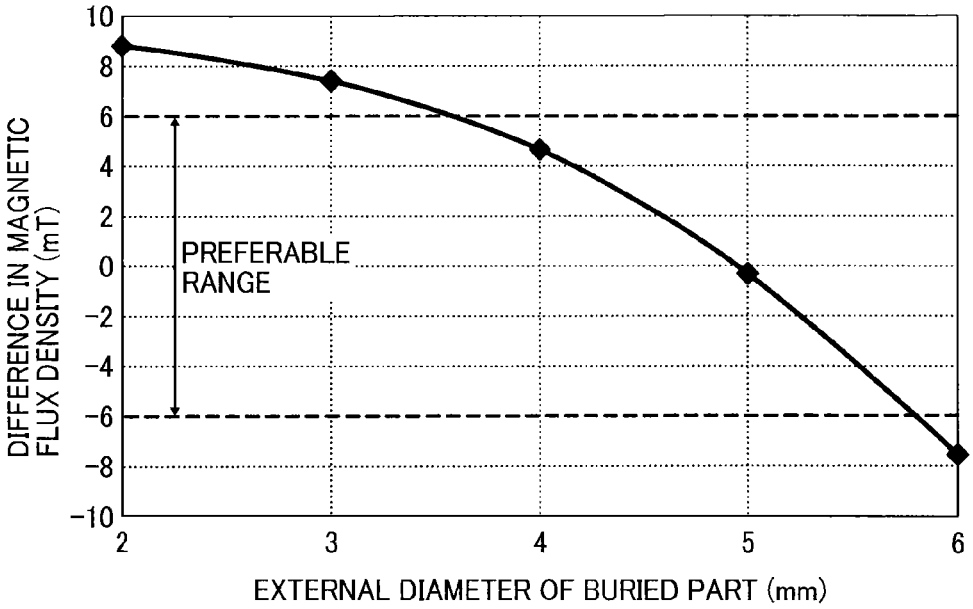
FIG. 17 is a graph illustrating the relation between the outer diameter of the buried part (small-diameter portion) and a difference calculated by deducting the magnetic flux density at a center from the magnetic flux density at an end.

Additionally, regarding the above-described embodiment, multiple magnet rollers including the buried part 332 (reduced-area portion) having external diameters different from each other were produced, and axial changes in the magnetic flux density thereof were measured. Specifically, the magnetic flux density was measured sequentially while the probe for measuring magnetic flux density disposed close to the main development pole (i.e., the rare-earth magnet block) of the magnet roller was moved axially from the center portion of the magnet roller to one end where the first support portion was provided. The magnetic flux density Ba at the axial center is deducted from the maximum magnetic flux density Bb among the measured values, thereby obtaining the difference ΔB. FIG. 17 is a graph illustrating the relations between the difference ΔB and the external diameter of the buried part 332 (reduced-area portion). Similarly to the above-described evaluation, when there is no value greater than the magnetic flux density Ba at the axial center, the value obtained by deducting the magnetic flux density Ba from the value measured at one end of the body of the magnet roller was regarded as the difference ΔB.

It can be known from FIG. 17 that, when the external diameter of the buried part (reduced-area portion) is within a range from 3.5 mm to 5.7 mm, the difference ΔB is within the desired range (e.g., ±6 mT). As the external diameter of the buried part increases, the difference ΔB in the magnetic flux density changes from a positive value to a negative value, and thus passes through the point where the difference ΔB in the magnetic flux density is zero. Accordingly, the difference ΔB in the magnetic flux density can be reduced close to zero by adjusting the external diameter of the buried part. Thus, the effect of the embodiment and its variations described in this specification can be confirmed.

Numerous additional modifications and variations are possible in light of the above teachings. It is therefore to be understood that, within the scope of the appended claims, the disclosure of this patent specification may be practiced otherwise than as specifically described herein.

What is claimed is:

1. A magnet roller comprising:

a roller-shaped body constructed of a magnetic field generating material;

a first support rod provided to a first axial end of the body; and a second support rod provided to a second axial end of the body, wherein at least one of the first and second support rods is constructed of a nonmagnetic material and includes a projecting part projecting outside the body from an end face of the body and a buried part united to the projecting part and positioned inside the body from the end face of the body, and the buried part includes a reduced-area portion smaller in cross-sectional area perpendicular to an axial direction of the first and second support rods than a corresponding cross-sectional area of a base end of the projecting part adjacent to the buried part, and the base end of the projecting part directly abuts an axial end surface of the body.

2. The magnet roller according to claim 1, wherein the reduced-area portion is rod-shaped.

3. The magnet roller according to claim 2, wherein the reduced-area portion comprises multiple rod-shaped portions different in external diameter, the multiple rod-shaped portions arranged in the axial direction in an order in which the cross-sectional area decrease with increasing distance from the projecting part.

4. The magnet roller according to claim 1, wherein the reduced-area portion comprises a tapered portion tapered with increasing distance from the projecting part.

5. The magnet roller according to claim 1, wherein the reduced-area portion comprises a first portion and a second portion smaller in cross-sectional area perpendicular to the axial direction than the first portion, and the second portion is positioned between the first portion and the projecting part in the axial direction.

6. The magnet roller according to claim 1, wherein an axis of the first support rod is aligned with an axis of the second support rod and parallel to an axial direction of the body.

7. A developer bearer comprising:

the magnet roller according to claim 1; and a hollow cylindrical rotator provided on an outer surface of the magnet roller to rotate around an axis relative to the magnet roller.

8. A development device comprising:

a magnet roller including a roller-shaped body constructed of a magnetic field generating material and first and second support rods provided to first and second axial ends of the body; respectively; and a support rod mount to which the first and second support rods are fixed, wherein at least one of the first and second support rods is constructed of a nonmagnetic material and includes a projecting part projecting outside the body from an end face of the body and a buried part united to the projecting part and positioned inside the body from the end face of the body, and the buried part includes a reduced-area portion smaller in cross-sectional area perpendicular to an axial direction of the first and second support rods than a corresponding cross-sectional area of a base end of the projecting part adjacent to the buried part, and the base end of the projecting part directly abuts an axial end surface of the body.

9. An image forming apparatus comprising:

a latent image bearer; and a development device to develop a latent image formed on the latent image bearer with developer, the development device including:

a magnet roller including a roller-shaped body constructed of a magnetic field generating material and first and second support rods provided to first and second axial ends of the body, respectively; and a support rod mount to which the first and second support rods are fixed, wherein at least one of the first and second support rods is constructed of a nonmagnetic material and includes a projecting part projecting outside the body from an end face of the body and a buried part united to the projecting part and positioned inside the body from the end face of the body, and the buried part includes a reduced-area portion smaller in cross-sectional area perpendicular to an axial direction of the first and second support rods than a corresponding cross-sectional area of a base end of the projecting part adjacent to the buried part, and the base end of the projecting part directly abuts an axial end surface of the body.

10. A process cartridge comprising:

the latent image bearer;

the development device, and a unit casing to house the latent image bearer and the development device, wherein the process cartridge is removably installed in the image forming apparatus according to claim 9.

* * * * *